United States Patent [19]

Rushing et al.

[11] 4,191,611

[45] Mar. 4, 1980

[54] APPARATUS FOR ULTRASONICALLY CLEANING PAPER MAKING FELT

[76] Inventors: John C. Rushing, 413 E. Seven Oak Dr., Greenville, S.C. 29607; William E. Smith, Rte. 2, Box 24; Henry L. King, P.O. Box 1255, both of Hartsville, S.C. 29550

[21] Appl. No.: 938,859

[22] Filed: Sep. 1, 1978

[51] Int. Cl.[2] ..... D21F 1/32; B08B 3/12

[52] U.S. Cl. ..... 162/273; 68/3 SS; 134/122 R; 134/184; 162/275; 162/279

[58] Field of Search ..... 162/273, 275, 279, 318, 162/199, 200; 134/1, 122 R, 184; 8/159, DIG. 12; 68/3 SS

[56] References Cited

U.S. PATENT DOCUMENTS

| | | | |
|---|---|---|---|
| 1,568,259 | 1/1926 | Wilson | 162/279 |
| 2,699,592 | 1/1955 | Newnam | 8/159 X |
| 2,800,682 | 7/1957 | Dooley | 8/159 X |
| 3,158,886 | 12/1964 | Grimes | 134/1 X |
| 3,190,793 | 6/1965 | Starke | 134/1 X |
| 3,240,963 | 3/1966 | Sasaki | 134/1 X |
| 3,298,904 | 1/1967 | LeCompte, Jr. | 134/122 R |
| 3,650,892 | 3/1972 | Genz et al. | 162/275 |
| 3,688,527 | 9/1972 | Blustain | 162/275 X |
| 3,712,085 | 1/1973 | Guberman et al. | 68/3 SS |
| 3,829,328 | 8/1974 | Blustain | 134/1 |

FOREIGN PATENT DOCUMENTS

| | | | |
|---|---|---|---|
| 888043 | 8/1953 | Fed. Rep. of Germany | 162/275 |
| 2518939 | 11/1976 | Fed. Rep. of Germany | 68/3 SS |
| 687970 | 2/1953 | United Kingdom | 68/3 SS |
| 1216664 | 12/1970 | United Kingdom | 162/275 |
| 199633 | 10/1967 | U.S.S.R. | 134/122 |

OTHER PUBLICATIONS

Paper Trade Journal, Jan. 15, 1977; cover page and pp. 24–26.

*Primary Examiner*—Richard V. Fisher

*Attorney, Agent, or Firm*—Bell, Seltzer, Park & Gibson

[57] ABSTRACT

An apparatus for cleaning an endless paper making felt continuously during the paper making process, and wherein the moving felt is passed through a cleaning bath, and ultrasonic vibrations are applied substantially uniformly across the entire width of the felt while the felt is immersed in the bath, to thereby achieve uniform cleaning of the felt and thus uniformity in the paper produced on the machine. The apparatus comprises an open, rectangular tank having a removable end wall, and a guide roll and ultrasonic transducers movably mounted in the tank, whereby the endless felt may be readily removed and/or replaced by removing the end wall, and lifting the guide roll and transducers, so that the felt may be slipped into the tank beneath the guide roll and transducers.

7 Claims, 7 Drawing Figures

APPARATUS FOR ULTRASONICALLY CLEANING PAPER MAKING FELT

The present invention relates to an apparatus for continuously cleaning a moving web material, and in the specific illustrated embodiment, the invention is utilized to clean an endless paper making felt continuously during the paper making process.

It has long been recognized in the paper making industry that fibrous cellulose particles and other contaminants adhere to the paper making felt, and that removal of these materials is desirable to insure a proper and uniform de-watering of the web thereon. A clean felt having open pores permits more of the moisture to be removed from the formed paper ply in the presses, and since the can dryers are able to remove only a certain amount of water, the less water in the paper permits the speed of operation of the machine to be increased.

In present commercial paper making operations, the felts are cleaned by one of several conventional procedures. One such procedure includes a rotating beater bar or "whipper" which repeatedly strikes the moving felt to dislodge the fibrous residue and foreign particles. Also, a water shower is usually employed in combination with the beater bar to wash away the dislodged particles. However, this procedure is not totally satisfactory since it is able to provide only limited cleaning, and the beater bar causes wear on the felt, thus necessitating its frequent removal and replacement. Also, beater bar cleaning is an exceedingly noisy operation.

It is also conventional to clean the moving felt by a cleaning shower wherein a soap solution is applied across the entire width of the felt and then removed by suction upon the felt passing a vacuum box. Certain systems of this type apply the shower under relatively low pressure, while others employ high pressure needle-like streams, but in either case difficulties are encountered. More particularly, the low pressure systems are inadequate to dislodge the fibers, and the high pressure systems tend to cause deterioration of the felt.

Still another conventional felt cleaning system is referred to as a felt conditioner in the trade, and comprises a series of shoes which are oscillated laterally across the moving felt. Each shoe deposits the cleaning solution on the felt, and includes a vacuum box for subsequently removing the solution. As will be apparent, this procedure produces no impingement on the moving felt, and thus it is unable to dislodge all of the fibers. Also, this procedure will result in nonuniformity in the paper produced on the machine, since the traversing cleaning head will clean only a portion of the felt during each cycle through the machine. Thus the felt will have areas which are more clean than other areas, which in turn will result in nonuniform slurry application and nonuniform drainage. Also, it is believed that this procedure will produce problems in coordinating the speed of reciprocation of the cleaning head with the speed of the felt, which is necessary to insure eventual coverage of the full area of the felt.

The U. S. patents to Blustain, U.S. Pat. Nos. 3,688,527 and 3,829,328, illustrate a modification of the above felt conditioner, and wherein an ultrasonically vibrating cleaning head is positioned on the oscillating shoe. The vibrating head produces vibrations of large displacement amplitude in the fluid, which are said to release the fibers from the felt. However, it is believed that the proposed Blustain apparatus will still suffer from nonuniformity in the paper for the reasons noted above.

It is accordingly an object of the present invention to provide an apparatus for efficiently cleaning a moving web of material, and which avoids the above noted deficiencies of the prior practices.

It is a more particular object of the present invention to provide an apparatus for cleaning a paper making felt continuously during the paper making process, and which minimizes wear on the felt, and is essentially noiseless in operation.

It is still another object of the present invention to provide an apparatus for substantially uniformly cleaning the full width of a paper making felt during each cycle through the paper making apparatus, and which is adapted to permit the ready removal and/or replacement of the endless felt.

These and other objects and advantages of the present invention are achieved in the embodiment illustrated herein by the provision of an apparatus which comprises an open, rectangular tank which is adapted to be filled with a cleaning bath, and which includes a removable plate section forming one end wall thereof. A guide roll is positioned adjacent the bottom wall of the tank for guiding the felt through the bath in the tank, and a support panel is positioned within the tank and immediately above the tank, with the support panel in turn mounting ultrasonic generating means. The guide roll and support panel are mounted to the tank so that they may be moved upwardly when the plate section is removed, whereby the endless felt may be slipped through the open end wall of the tank and beneath the guide roll and support panel.

Some of the objects having been stated, other objects will appear as the description proceeds, when taken in connection with the accompanying drawings in which.

Figure 1:
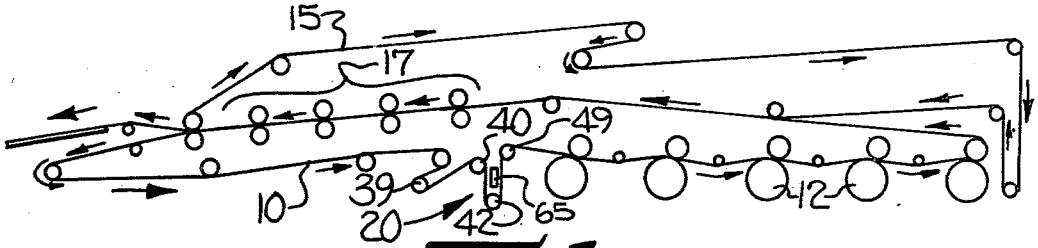
FIG. 1 is a schematic representation of a cylinder paper making machine wet end, which includes a felt cleaning apparatus in accordance with the present invention.

Referring more particularly to the drawings, FIG. 1 is a schematic representation of a conventional cylinder paper making machine wet end, and which includes a felt cleaning apparatus in accordance with the present invention. In particular, the paper making machine includes an endless paper making felt 10 which passes through a total of five rotary cylinders 12. As is conventional, each cylinder 12 is screen covered, and is mounted in a vat 14 which holds the paper making slurry. As the cylinder revolves, water drains through the screen to the interior of the cylinder, and a wet sheet of the slurry is formed on the surface thereof. This sheet is removed and received on the felt 10 at the top of each cylinder, with the downstream sheets being joined to form a thicker laminated sheet. The felt 10 then converges with an upper felt 15, and the two felts carry the wet paper through a press section 17. The paper is then transferred from the two felts and transported to the dryer section (not shown).

While the present invention is specifically illustrated herein in association with a cylinder paper making machine wet end, it will be understood that the invention is equally applicable for cleaning the press felts of both fourdrinier and cylinder paper making machines, as well as the forming wire or forming fabric of a fourdrinier machine, and other moving webs. In this regard, the term "felt" as employed herein is intended to encompass any of the endless belts used in the conventional paper making machines.

The cleaning apparatus of the present invention is indicated generally at 20, and will be seen to be positioned along the return run of the felt 10 and where the felt is free of any paper. As illustrated, the apparatus 20 is positioned immediately upstream of the initial rotary cylinder 12.

The cleaning apparatus 20 includes an open rectangular tank 22 which is adapted to be filled with a cleaning bath or solution, and which comprises a bottom wall 24, opposing side walls 25, 26, and opposing first and second end walls 28, 29 respectively. The side walls 25, 26 and end walls 28, 29 define a generally planar upper periphery, and the end walls include aligned openings 31, 32 therethrough which are positioned adjacent the bottom wall 24. The first end wall 28 also includes a removable plate section 35 having a flanged upper edge 36, which defines a portion of the upper periphery of such end wall, and a lower edge 37 which defines the upper periphery of the associated opening 32. The plate section 35 is removably attached to the remaining portion of the wall by bolts or the like.

In order to guide the moving paper making felt 10 through the tank 22 so as to be immersed in the cleaning bath, there is provided an upstream stretch roll 39, which is adjustably mounted in a conventional manner so as to permit movement toward and away from the tank 22 to thereby permit the tension in the felt to be adjusted. An upstream guide roll 40 is positioned immediately above and parallel to the side wall 25, and another guide roll 42 is positioned adjacent and parallel to the bottom wall 24 of the tank so as to be submerged in the bath. The guide roll 42 has a support shaft 43 extending coaxially from each end, and the shafts 43 extend through the aligned openings 31, 32 of the tank end walls. A packing gland 44 of conventional design surrounds each shaft 43 adjacent the outside of each end wall to form a water tight seal therebetween, the gland being releasably attached to its associated end wall by means of bolts or the like. Also, there is provided a bearing 46 outside of each end wall for rotatably mounting the ends of the shafts, the bearings being designed with a removable cap 47 which permits the shaft 43 to be lifted and removed therefrom. Another guide roll 49 is positioned in spaced relation above the upper peripheral edge of the opposite side wall 26. The rolls 40 and 49 each preferably include a grooved surface which acts to spread the moving felt 10 widthwise, to thereby open the pores of the felt and thus facilitate the removal of the fibrous residue. Rolls of this nature are well known, and are commonly referred to as "worm" rolls.

By the above arrangement, it will be seen that the felt 10 is guided from the stretch roll 39 to the roll 40, where it is laterally spread and directed downwardly into the tank 22. The felt then passes beneath and around the submerged roll 42, and over the roll 49. The movement of the felt thereby defines a generally U-shaped path of travel through the bath in the tank, and which includes a downwardly directed upstream run 51, and an upwardly directed downstream run 52 which is generally parallel to the run 51.

The apparatus 20 further includes means for generating ultrasonic vibrations within the bath of the tank 22, and which includes a support panel 54 extending between the end walls 28, 29 and positioned between the runs 51, 52 of the U-shaped path of travel of the felt and so as to be positioned directly above the guide roll 42. The panel 54 is of generally planar, rectangular configuration and defines a widthwise direction extending between the end walls 28, 29, and a length direction which is perpendicular to the direction of movement of the felt during the two runs. Also, the panel 54 will be seen to lie in a plane parallel to the planes defined by the two runs.

Figure 3:
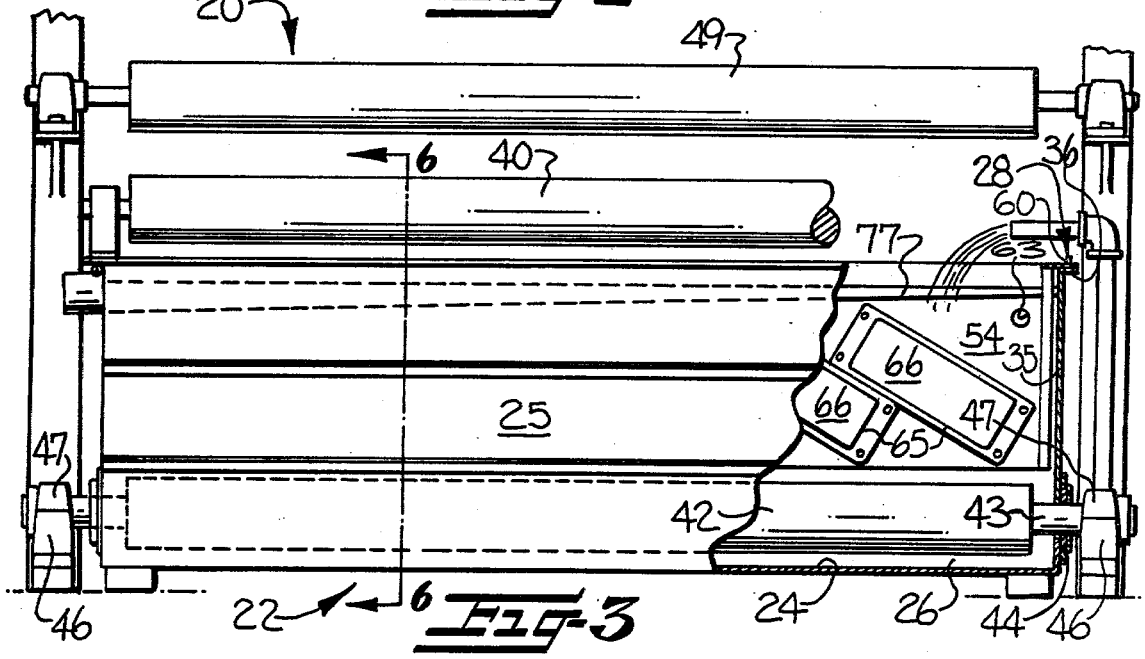
FIG. 3 is a front elevation view, partly broken away, of the felt cleaning apparatus.
Figure 5:
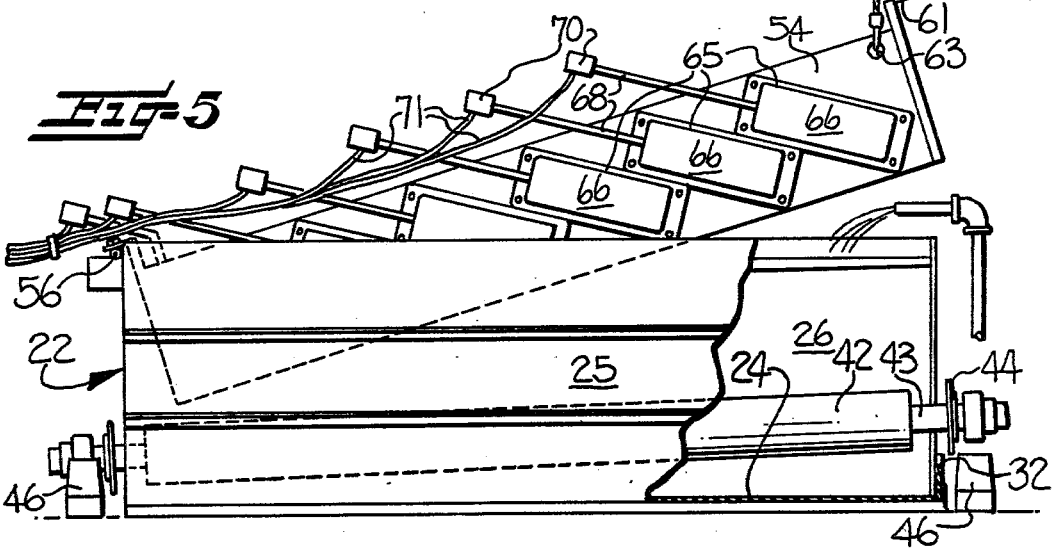
FIG. 5 is a front elevation view, partly broken away, of the cleaning apparatus in its position for replacement of the felt.
Figure 6:
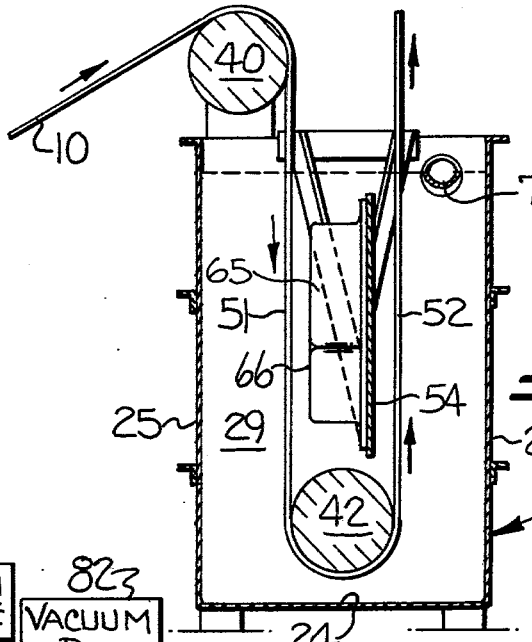
FIG. 6 is a sectional side elevation view of the tank taken substantially along the line 6—6 of FIG. 3.

The panel 54 is mounted in the tank 22 by an arrangement which permits it to be readily moved upwardly from the guide roll 42 to the position shown in FIG. 5. This mounting arrangement comprises a hinge 56 mounted to the upper periphery of the second end wall 29, with the hinge being pivotable along an axis parallel to the direction of the upper periphery of the wall 29. The upper plate of the hinge includes a pair of bolts 58 which are adapted to be received in the slots of a mating bracket 59 attached to the adjacent end of the panel. In addition, the flanged upper edge 36 of the plate section 35 includes a similar pair of bolts 60, which are adapted to be received in the slots of a like bracket 61 at the other end of the panel. The slotted interconnection between the panel 54 and each of the end walls 28, 29 serves to permit the panel to be adjustably moved toward and away from the upstream run 51 of the felt. Also, the panel 54 may be lifted by releasing the interconnection between the panel and plate section 35 and pivoting the panel about the axis of the hinge 56. An opening 63 may be provided adjacent one end of the panel to facilitate its lifting, note FIGS. 3 and 5.

Six separate ultrasonic transducers 65 are mounted in an adjacent side-by-side arrangement along the full widthwise direction of the panel 54. The ultrasonic transducers 65 are of conventional design, and include a generally rectangular outer vibration generating surface 66 which is parallel to the plane of the panel, and also parallel to and immediately adjacent the upstream run 51 of the felt. As best seen in FIG. 5, the transducers 65 are angularly oriented on the panel at an angle of about 55 degrees from the vertical, and such that corner portions of adjacent generating surfaces overlap along the length direction of the panel. By this arrangement, all areas along the widthwise direction of the felt 10 is exposed to a substantially equal linear length of vibrating surface 66, which preferably measures at least about six inches, to thereby achieve a substantially uniform application of the ultrasonic vibrations across the full width of the moving felt. Typically, the outer surfaces 66 of the transducers are spaced between about one-half to one inch from the upstream run 51 of the felt, with the spacing being adjustable by reason of the slotted interconnection between the panel and tank. Such adjustable spacing is desirable to accommodate differing types of felt constructions and levels of contamination.

A submersible ultrasonic transducer suitable for use with the present invention is readily available on the market. One suitable commercially available transducer has an effective flat generating surface which measures about 6 by 17 inches, and the vibrations have a frequency of at least about 20,000 cycles per second, and with an intensity of ten watts per square inch. A tube 68 carries the electrical leads from each transducer 65 to a watertight junction box 70, from which a flexible cable 71 leads to the ultrasonic generator 72 (note FIG. 7). Operation of the generator 72 is controlled by a switch 74 positioned in the tank 22. The switch 74 is in turn controlled by the level of the bath in the tank, and is designed to terminate operation of the generator 72 and thus the transducers 65 upon the liquid level dropping below a predetermined minimum, and thereby protect the transducers from overheating should they become no longer submerged. In this regard, it will be understood that the transducers 65 add heat to the bath, which facilitates the cleaning operation. The exact temperature to which the bath is raised depends upon a number of factors, but typically ranges between 110 to 150 degrees F. While a specific transducer construction and a specific orientation of the several transducers on the panel have been illustrated and described herein, it will be understood that an important consideration in selecting the transducers and their orientation is to achieve as uniform an intensity of vibration at every point on the moving web as possible, and that other transducers and orientations may be employed to achieve this objective.

Figure 7:
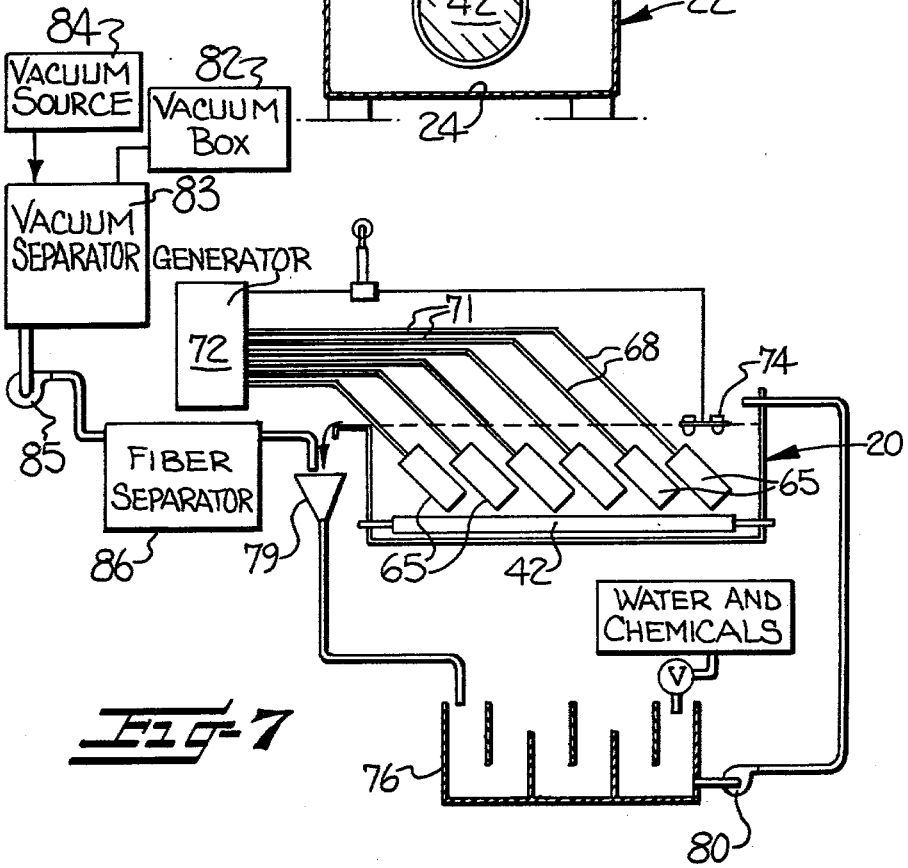
FIG. 7 is a schematic representation of the tank together with the circulation system for the cleaning bath.

The circulation system for the bath in the cleaning tank 22 is illustrated somewhat schematically in FIG. 7, and includes a separate holding tank 76, and means for circulating the bath from the cleaning tank 22 to the holding tank 76 and back to the cleaning tank. This circulating system includes a horizontally disposed drain trough 77 positioned within the cleaning tank so as to extend parallel to and immediately adjacent the plane defined by the downstream run 52 of the felt, whereby the movement of the felt through the tank causes the bath to circulate toward the drain trough 77. The holding tank 76 is typically positioned below the cleaning tank 22, so that the bath received in the drain trough 77 flows by gravity first to the drain 79, and then to the holding tank 76. A pump 80 is employed to return the bath from the holding tank 76 to the cleaning tank 22. Also as illustrated in FIG. 7, the holding tank 76 serves as a convenient location at which additional water may be added to the system. In addition, suitable cleaning chemicals may be added to the bath at the holding tank, to facilitate the cleaning action of the bath.

The particular chemicals employed in the bath will depend on a variety of factors, including the type of contaminants in the felt and the material of the felt. In addition, it is desirable to select a chemical solution which will be low sudsing, lends itself to ultrasonic cavitation, has good wetting properties, and is a good rinser. A typical alkaline or neutral felt cleaning formulation would include sodium metasilicate, sodium tripolyphosphate, 2-butoxy ethanol, nonyl phenoxy polyethoxy ethanol with 10.5 moles ethylene oxide, and sodium salt of linear alkyl benzene sulfonic acid. A typical mild acid formulation would include phosphoric acid, gluconic acid, nonyl phenoxy polyethoxy ethanol with 10.5 moles ethylene oxide, and 2-butoxy ethanol.

Figure 2:
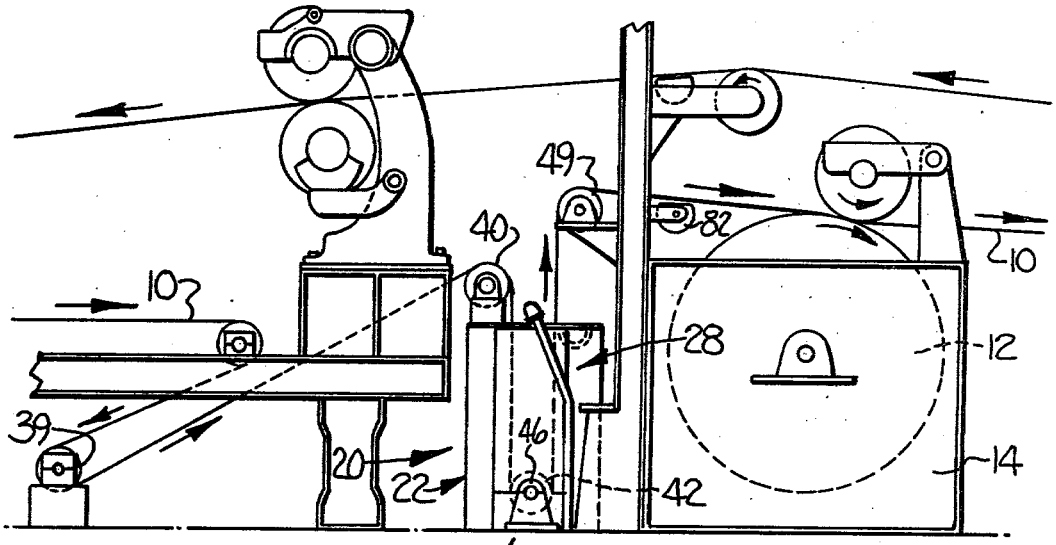
FIG. 2 is a side elevation of a portion of the machine shown in FIG. 1, and illustrating the felt cleaning apparatus.

As best seen in FIGS. 2 and 7, an upwardly facing vacuum box 82 is positioned to extend transversely across the moving felt 10 and immediately downstream of the roll 49. The vacuum box 82 is connected to a conventional vacuum separator 83 and vacuum source 84, and the outlet line from the separator 83 includes a pump 85 and fiber separator 86. The fiber separator 86 acts to separate the fibrous residue from the bath, and may for example comprise a conventional centrifugal separator. The cleaned portion of the bath is then returned via the drain 79 to the holding tank 76.

During operation of the paper making machine, the felt 10 continuously passes around the stretch roll 39, and is guided into and through the tank by the guide rolls 40, 42, 49. As the felt passes through the tank, the upstream run 51 is subjected to ultrasonic vibrations, which are generated on the side opposite that upon which the paper is formed. As will be apparent, the majority of the fibrous residue is positioned on the side of the felt upon which the paper is formed, and the indicated positioning of the transducers 65 results in the vibrational energy passing through the felt and displacing the residue in an outward rather than an inward direction with respect to the body of the felt. Also, the intensity of the vibrations may be adjusted by moving the panel toward and away from the upstream run 51 of the felt in the manner described above.

As the felt leaves the bath in the tank, a part of the bath and dislodged residue will be carried on the surface of the felt, and a substantial portion thereof is removed from the felt upon passing over the vacuum box 82. In this regard, it will be noted that the vacuum is applied from the side of the felt upon which the paper is formed, and wherein the greater portion of the fibrous residue will be located. The bath and particles removed by the vacuum pass through the vacuum separator 83 and to the fiber separator 86, wherein a substantial portion of the fibrous residue is separated and removed. The cleaned portion of the bath is then returned to the holding tank 76. By this arrangement, the cleaning chemicals and heat energy in the bath may be effectively retained, and polluting effluent from the system is minimized.

Figure 4:
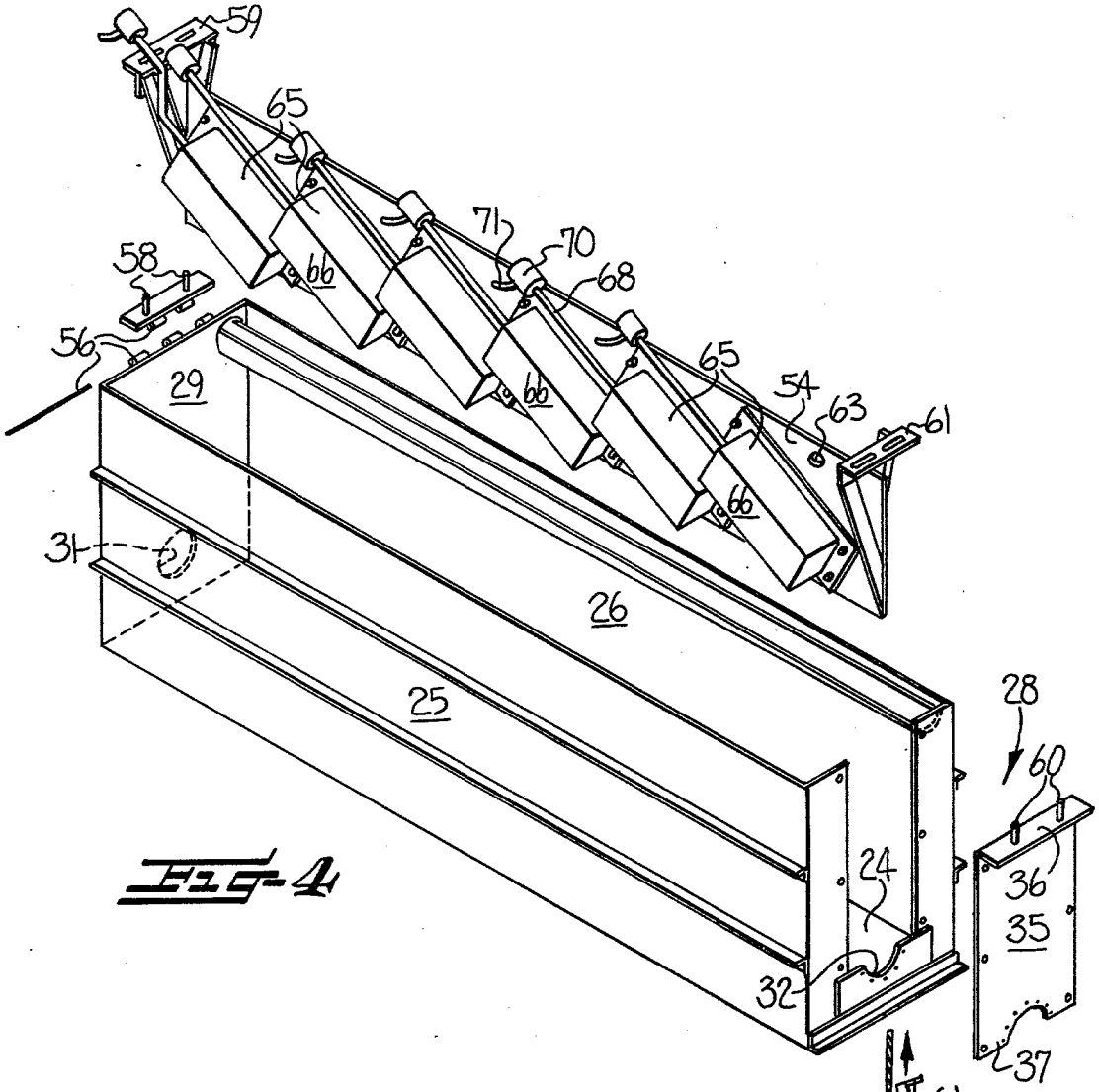
FIG. 4 is an exploded perspective view illustrating the tank and ultrasonic transducers of the cleaning apparatus.

The apparatus of the present invention is also uniquely adapted to permit the ready replacement of the endless felt 10. The procedure for accomplishing this replacement is illustrated in FIGS. 4 and 5, and comprises a number of steps which permit the tank 22 to be opened at one end so as to permit the felt 10 to slide beneath the roll 42 and into the tank. More particularly, the replacement is accomplished by initially cutting and stripping the worn felt from the machine. The stretch roll 39 is then moved toward the tank 22, and the tank is then opened by first removing the bolts which mount the transducer panel 54 to the plate section 35. The packing glands 44 are released from the end walls and the caps 47 of the two bearings 46 are removed. Next, the plate section 35 is removed from the tank, and the transducer panel 54 and roll 42 are then lifted to the positions shown in FIG. 5 by a hoist or other suitable lifting device. In this configuration, the new felt may be slipped through the opening in the end wall 28 and beneath the roll 42. The roll 42 and panel 54 are then lowered to their operation position, and the tank 22 is closed in the manner which will be apparent.

In the drawings and specification, there has been set forth a preferred embodiment of the invention, and although specific terms are employed, they are used in a generic and descriptive sense only and not for purposes of limitation.

That which is claimed is:

1. An apparatus for continuously cleaning a moving endless web material, and which is characterized by the ability to permit rapid removal and/or replacement of the web material, said apparatus comprising an open, rectangular tank adapted to be filled with a cleaning bath, said tank comprising a bottom wall, opposing side walls, and opposing first and second end walls, with said end walls including aligned openings therethrough and which are positioned adjacent said bottom wall, and with said first end wall including a removable plate section having an upper edge which defines at least a portion of the upper periphery of such end wall and a lower edge which defines the upper periphery of the associated opening, means for guiding a moving web material through the tank so as to be immersed in the cleaning bath, and including a guide roll positioned adjacent the bottom wall of said tank, said guide roll having a support shaft extending coaxially from each end and with the shafts extending through said aligned openings of said tank end walls, releasable means for sealing each support shaft to its associated end wall, and means positioned outside each end wall of said tank for rotatably and releasably mounting said support shafts, whereby the moving web material is adapted to extend around said guide roll and define a U-shaped path of travel through the tank and which includes two oppositely directed runs, means for generating ultrasonic vibrations within the bath in said tank and including a support panel extending between said end walls and positioned between said runs of said U-shaped path of travel and directly above said guide roll, and means for mounting said panel to said tank so as to permit the panel to be readily moved upwardly from said guide roll, whereby the endless web material may be replaced by moving the panel upwardly, releasing said sealing means, releasing the mounting of the ends of said guide roll support shafts, removing said plate section, and lifting the guide roll so that the web material may be slipped therebeneath.

2. The apparatus as defined in claim 1 wherein said ultrasonic generating means further comprises a plurality of separate ultrasonic transducers mounted on said panel, with said generators being positioned to achieve a substantially uniform application of the ultrasonic vibrations across the full width of the moving web material.

3. The apparatus as defined in claim 2 wherein said means for mounting said panel to said tank comprises a hinge mounted to the upper periphery of said second end wall, with said hinge being pivotable along an axis parallel to the direction of the upper periphery of said second end wall, and means for releasably interconnecting one end of said panel to said upper edge of said plate section and the other end to said hinge, whereby said panel may be moved upwardly from said guide roll by releasing the interconnecting between said panel and plate section and pivoting the panel about the axis of said hinge.

4. The apparatus as defined in claim 3 wherein said means for releasably interconnecting the panel to each of said plate section and said hinge includes a slotted interconnection, whereby said panel may be adjustably moved toward and away from said upstream run of the web material.

5. The apparatus as defined in claim 4 wherein said guiding means further comprises a second guide roll mounted immediately above said tank and positioned to guide the moving web material into the tank, and wherein said second guide roll includes grooved surface means for spreading the moving web material widthwise to thereby open the pores of the material as it enters said tank.

6. In a continuous paper making apparatus which includes an endless paper making felt upon which the slurry is received, the combination therewith of means for cleaning the fibrous residue from the felt continuously during the paper making process, and which is characterized by the ability to permit rapid removal and/or replacement of the felt, said cleaning means comprising an open, rectangular tank adapted to be filled with a cleaning bath, said tank comprising a bottom wall, opposing side walls, and opposing first and second end walls, with said end walls including aligned openings therethrough and which are positioned adjacent said bottom wall, and with said first end wall including a removable plate section having an upper edge which defines at least a portion of the upper periphery of such end wall and a lower edge which defines the upper periphery of the associated opening, means for guiding a moving paper making felt through the tank so as to be immersed in the cleaning bath during a portion of the return run of the felt, and including a guide roll positioned adjacent the bottom wall of said tank, said guide roll having a support shaft extending coaxially from each end and with the shafts extending through said aligned openings of said tank end walls, releasable means for sealing each support shaft to its associated end wall, and means positioned outside each end wall of said tank for rotatably and releasably mounting said support shafts, whereby the moving felt is adapted to extend around said guide roll and define a U-shaped path of travel through the tank and which includes two oppositely directed runs, means for generating ultrasonic vibrations within the bath in said tank and including a support panel extending between said end walls and positioned between said runs of said U-shaped path of travel and directly above said guide roll, and a plurality of separate ultrasonic transducers mounted on said panel, with said generators being positioned to achieve a substantially uniform application of the ultrasonic vibrations across the full width of the moving felt, and means for mounting said panel to said tank so as to permit the panel to be readily moved upwardly from said guide roll, whereby the endless felt may be replaced by moving the panel upwardly, releasing said sealing means, releasing the mounting of the ends of said guide roll support shafts, removing said plate section, and lifting the guide roll so that the felt may be slipped therebeneath.

7. The apparatus as defined in claim 6 wherein said panel is mounted so as to be parallel to the plane defined by the upstream run of said U-shaped path of travel of the felt through the tank, and such that the ultrasonic transducers are positioned adjacent the side of the felt opposite that upon which the slurry is received.

* * * * *

UNITED STATES PATENT AND TRADEMARK OFFICE

CERTIFICATE OF CORRECTION

PATENT NO. : 4,191,611

DATED : March 4, 1980

INVENTOR(S) : John C. Rushing et al

It is certified that error appears in the above-identified patent and that said Letters Patent are hereby corrected as shown below:

Column 4, line 18, after "is perpendicular to the" insert --widthwise direction and parallel to the--.

Signed and Sealed this

*Eighth* Day of *July 1980*

[SEAL]

*Attest:*

SIDNEY A. DIAMOND

*Attesting Officer*

*Commissioner of Patents and Trademarks*